United States Patent [19]

Nozaka

[11] Patent Number: 4,597,820

[45] Date of Patent: Jul. 1, 1986

[54] METHOD OF AND DEVICE FOR PREPARING PAPER ROLLS FOR ROTARY PRESSES AND THE LIKE

[75] Inventor: Yoshiki Nozaka, Tokyo, Japan

[73] Assignee: Dai Nippon Insatsu Kabushiki Kaisha, Tokyo, Japan

[21] Appl. No.: 773,347

[22] Filed: Sep. 6, 1985

Related U.S. Application Data

[62] Division of Ser. No. 621,528, Jun. 18, 1984, Pat. No. 4,555,288.

[30] Foreign Application Priority Data

Jun. 20, 1983 [JP] Japan ..... 58-110665

[51] Int. Cl.[4] ..... B31F 5/06; B65H 19/18

[52] U.S. Cl. ..... 156/353; 83/362; 83/365; 83/368; 83/371; 83/678; 156/366; 156/502; 156/504; 156/510; 242/56 R; 242/56.8; 242/58.5

[58] Field of Search ..... 156/353, 157, 253, 510, 156/502, 504, 505, 366; 242/56 R, 56 B, 56.8, 58.1, 58.5; 83/471.2, 678, 362, 365, 368, 371

[56] References Cited

U.S. PATENT DOCUMENTS

| | | | |
|---|---|---|---|
| 2,149,832 | 3/1939 | Bernard | 242/58.5 |
| 2,320,656 | 6/1943 | Roesen | 242/58.5 |
| 3,082,141 | 3/1963 | Steele et al. | 156/510 |
| 3,212,381 | 10/1965 | Heyer | 83/678 |
| 4,173,314 | 11/1979 | Curran et al. | 156/502 |
| 4,527,750 | 7/1985 | Juntti | 242/56 R |

*Primary Examiner*—Michael Wityshyn

*Attorney, Agent, or Firm*—Koda and Androlia

[57] ABSTRACT

The web leading edge of a paper roll for a rotary press or the like is held and prevented from raveling by three or more pieces of strong adhesive tape during handling and loading onto a paper feed machine of the printing press. On the paper feed machine, perforated tear lines are formed across the tape pieces by a device comprising a rotary perforating wheel, a mechanism for moving the wheel from one end to the other of the roll and also moving it against and away from all of the tape pieces, and a tape detecting device and a controller for automatically operating the mechanism. The tape pieces can then be easily torn to release the web leading edge immediately prior to web splicing.

3 Claims, 8 Drawing Figures

METHOD OF AND DEVICE FOR PREPARING PAPER ROLLS FOR ROTARY PRESSES AND THE LIKE this is a division of application Ser. No. 621,528, filed June 18, 1984, now U.S. Pat. No. 4,555,288.

BACKGROUND OF THE INVENTION

This invention relates to a method of and device for preparing a new paper roll for a rotary press or the like, particularly with respect to processing pieces of strong adhesive tape for preventing raveling or separation of the web leading edge from the roll.

In automatic splicing of paper webs to be used in rotary presses and the like, it is necessary to fix the web leading edge of a new paper roll, prior to splicing, by means of pieces of tape or some other means so that the web leading edge will not become raveled or separate from the roll. However, since splicing is carried out at the instant of the web splicing, and since this splicing cannot be accomplished with the web leading edge still held by the tape pieces against the roll, the tape pieces or the like must be made easily tearable immediately prior to the splicing.

Accordingly, it has been a conventional practice to use a number of pieces of narrow tape which are stuck across the web leading edge with their narrow width direction parallel to the web leading edge. However, it has been found that such narrow pieces of tape are easily broken during handling and transportation of the roll or when the roll is being loaded onto a paper feed machine. Therefore, the common and troublesome procedure being resorted to in the present state of the art comprises using pieces of strong ravel-preventive tape on each roll, loading the roll in this state onto a paper feed machine, then peeling of the pieces of strong tape from the roll, and replacing them with pieces of narrow, easily-torn tape.

SUMMARY OF THE INVENTION

In view of the above described problem and situation, this invention seeks to solve the problem by providing a method of and device for processing pieces of strong tape stuck along and holding the web leading edge of a paper roll of the above described character so as to prevent raveling of the leading edge during handling, moving, and loading onto a paper feed machine of the roll, whereby the web leading edge can be easily peeled off the roll immediately prior to web splicing.

According to this invention in one aspect thereof, briefly summarized, there is provided a method of preparing a new paper roll for a rotary press or the like, which method comprises: preparing a strong adhesive tape having on one surface thereof a central nontacky zone and adhesive tacky zones flanking opposites of the nontacky zone; sticking beforehand, upon completion of reeling of paper to form the roll, a plurality of pieces of the adhesive tape over and to the web end and the part of the roll adjacent thereto so that the nontacky zone of each tape piece is disposed over and along the web leading edge of the roll; and, after the roll has been loaded onto a paper feed apparatus including web splicing means, forming from the outside a perforated line for tearing across each tape piece in the nontacky zone thereof substantially in the vicinity of and along the web leading edge thereby to facilitate tearing of the tape pieces and peeling of the web leading edge part immediately prior to web splicing.

According to this invention in another aspect thereof, briefly summarized, there is provided a device for preparing for splicing an unused new paper roll for a rotary press or the like, the paper roll being rotatably supported and having a web leading edge held against raveling by a plurality of pieces of strong adhesive tape, said device comprising: a traveling structure mounted for traveling parallelly to and in the vicinity of the web leading edge from one end to the other end of the paper roll; a rotary perforating wheel supported by the traveling structure with freedom to be pressed against and be separated from the surface of the paper roll; driving means for thus moving the rotary perforating wheel against and away from the paper roll surface; tape detecting means so supported on the traveling structure as to detect the adhesive tape pieces as the traveling structure thus travels and to output corresponding detection signals; and control means operating in response to the detection signals to activate the driving means to move the rotary perforating wheel against and along only the adhesive tape pieces and thereby to form a tearable perforated line across only the adhesive tape pieces substantially over and along the web leading edge, whereby tearing of the tape pieces and peeling of the web leading edge part immediately prior to web splicing are facilitated.

The nature, utility, and further features of this invention will be more clearly apparent from the following detailed description with respect to a preferred embodiment of the invention when read in conjunction with the accompanying drawings, briefly described below.

DETAILED DESCRIPTION OF THE INVENTION

Figure 1:
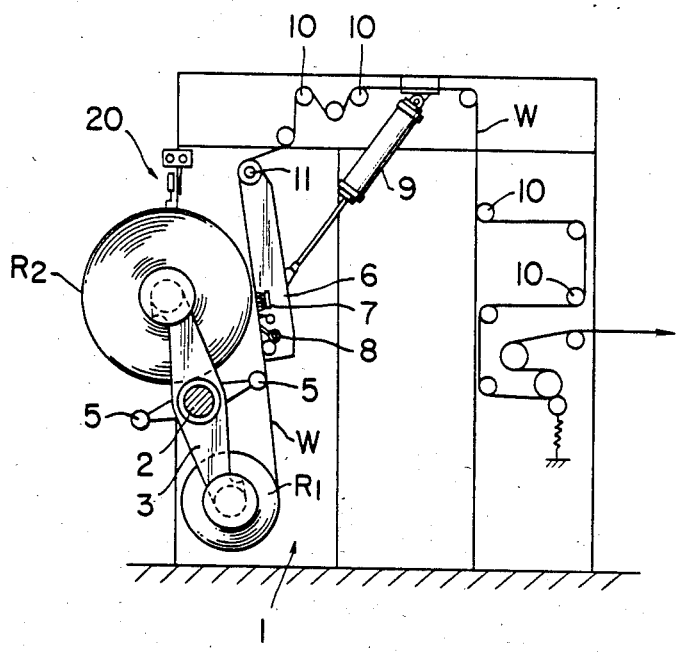
FIG. 1 is a side elevation showing a paper feed apparatus in which a tape processing device is installed.
Figure 2:
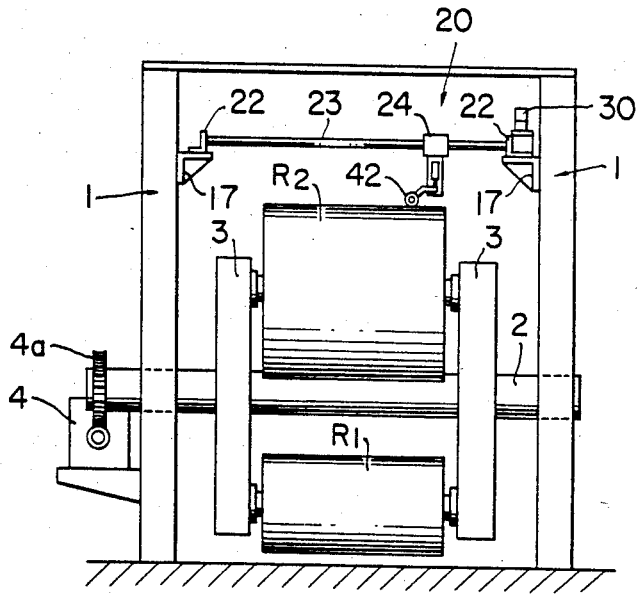
FIG. 2 is an elevation orthogonal to FIG. 1 of the same apparatus as viewed from the left in FIG. 1.

Referring first to FIGS. 1 and 2, the paper feeding apparatus of a rotary press shown therein and provided with a device for processing ravel-preventive tapes has an apparatus frame 1 supporting a horizontal rotating shaft 2 on which a pair of paper feed levers 3 are supported at spaced-apart positions and are mutually aligned in angular phase with respect to the axis of the shaft 2. The shaft 2 is drivable by a motor 4 via a speed-reduction mechanism 4*a*.

The paper feed levers 3, at and between the ends of their opposed arms, rotatably and detachably support web paper rolls R1 and R2 to rotate about parallel axes of rotation. R1 is an "old" or preceding paper roll, while R2 is a "new" or succeeding paper roll. Each paper feed lever 3 is provided at its middle part with a pair of outwardly projecting and rigidly fixed arms, at the outer ends of which guide rollers 5 are rotatably supported.

The web W drawn upwards and out from the web roll R1 is guided by the guide rollers 5 on the inner side of the apparatus, travels past and in the vicinity of a brush 7 and a knife 8 of a paper or web splicing arm 6 pivotally supported on the frame 1 in the known manner, and, guided further by a series of guide rollers 10, is sent out from the paper feeding apparatus. The paper splicing arm 6 is pivotally supported at its upper end by a pivot pin 11 and is actuatable by an air cylinder-piston actuator 9 (hereinafter referred to as an air cylinder) and is caused thereby to swing in the counterclockwise direction as viewed in FIG. 1 to be normally in a position separated from the web W, being caused by the extension of the air cylinder 9 to swing and advance to the position indicated in FIG. 1 only at the time of paper or web splicing. The brush 7 operates at the time of web splicing to press the web of the old web roll R1 against the web of the new web roll R2. The knife 8 operates at the time of web splicing to cut off the trailing edge part of the web of the old roll R1.

The tape processing device is supported in a manner permitting it to travel in a direction parallel to the axis of the roll R2 at the upper part of the frame 1 as indicated by reference numeral 20 in FIGS. 1 and 2.

Figure 3:
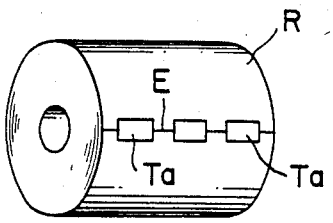
FIG. 3 is a perspective view of a paper roll, the web leading edge of which is held and prevented from raveling by strong adhesive tape pieces.
Figure 8:
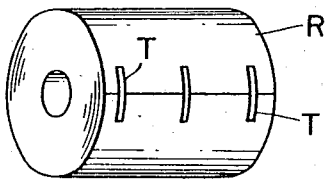
FIG. 8 is a perspective view similar to FIG. 3 showing a paper roll the web leading edge of which is held in the conventional manner with narrow pieces of adhesive tape.

According to this invention, instead of narrow pieces T of tape as shown in FIG. 8, which have been used in the prior art, a plurality of wide pieces Ta of adhesive tape are caused to adhere to and along the web leading edge E as shown in FIG. 3. As illustrated on a relatively enlarged scale in FIG. 4, each of these adhesive tape pieces Ta has a nontacky or nonadhesive zone 12 at the central part of its inner surface and tacky or adhesive zones 13 on opposite sides flanking the nontacky zone 12. Because of its great width in the transverse direction of the roll R, that is, the lateral direction parallel to the roll axis, each of these adhesive tape pieces Ta is strong. These adhesive tape pieces Ta are so placed against and caused to adhere to the surface of the roll R that their nontacky zones 12 will be over and along the extreme leading edge E of the web prior to the mounting of the roll R on the paper feed levers 3.

Figure 4:
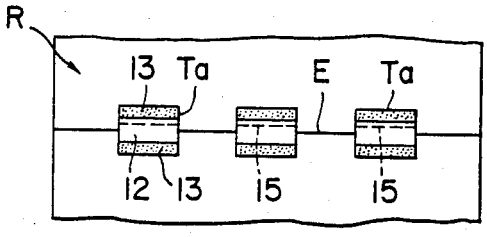
FIG. 4 is a fragmentary, relatively enlarged side view of the same roll and adhesive tapes pieces, which are inverted to show the construction of the inner adhesive face thereof.

While three pieces Ta of this adhesive tape are used in the example illustrated in FIGS. 3 and 4, any suitable number of these tape pieces can be selected. By thus fixing beforehand the web leading edge E by means of these strong tape pieces stuck to the roll R, there is almost no possibility of tearing of the tape pieces at the time of transportation and handling of the roll R or at the time of loading thereof onto the paper feed levers, as has happened in the past.

Upon completion of the mounting of the roll R on the paper feed levers 3, perforated lines for tearing off are cut in the nontacky zones 12 from their outer sides of all tape pieces Ta as indicated by reference numeral 15 in FIG. 4. These tear-off lines are formed substantially over and along the web leading edge E. By thus forming these perforated lines 15, the adhesive tape pieces Ta become easily tearable along these tear lines 15, whereby the peeling away of the web leading edge E for paper splicing is facilitated.

Next, a device for automatically forming the perforated tear lines 15 on the adhesive tape pieces Ta in this manner will be described. For thus forming these perforated lines 15, the aforementioned tape processing device 20 is used.

This tape processing device 20 is as shown in FIG. 2, mounted on brackets 17 respectively fixed to the apparatus frame 1 on opposite lateral sides of the paper feed levers 3 and the rolls R1 and R2. The brackets 17 support respective supporting members 22, by which the opposite ends of two slide bars 23 are fixedly supported. As shown in plan view in FIG. 7, these two slide bars 23 are parallel to and spaced apart from each other and slidably support a slide block 24, which is thereby free to slidably move in the longitudinal direction of the slide bars 23. These slide bars 23 are also parallel to the axes of the rolls R1 and R2.

Figure 5:
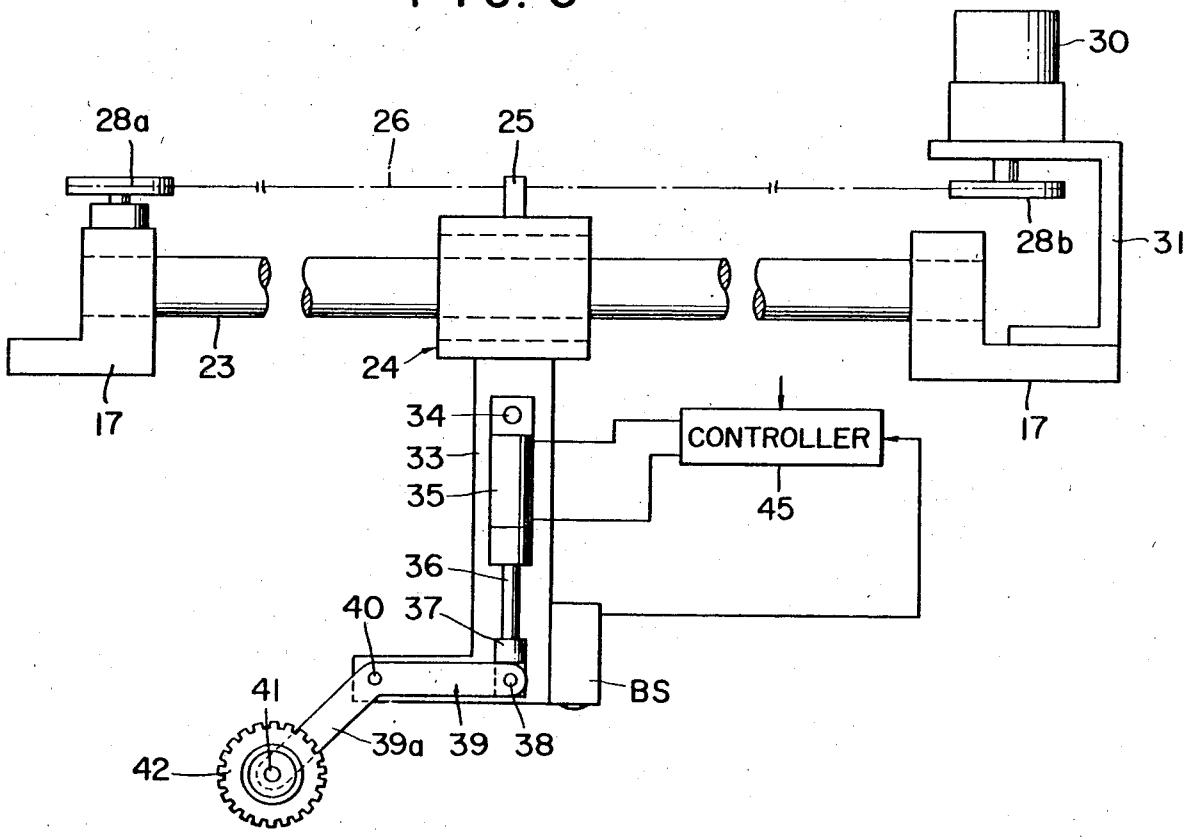
FIG. 5 is a side elevation, with some parts cut and foreshortened, showing the essential parts of one example of the tape processing device.

As shown in FIG. 5, a wire anchor member 25 is fixed to and projects upward from the top of the slide block 24 and serves as an anchor for the opposite ends of a length of wire cable 26 fixed thereto. This wire cable 26 thereby is in an endless form and passed around an idler pulley 28*a* rotatably supported on one of the brackets 17 and around a driven pulley 28*b* coupled to the rotor shaft of a reversible motor 30 mounted on a support 31 supported in turn on the other bracket 17. Thus, the slide block 24 can be driven to slide along the slide bars 23 in two directions by the motor 30.

Figure 6:
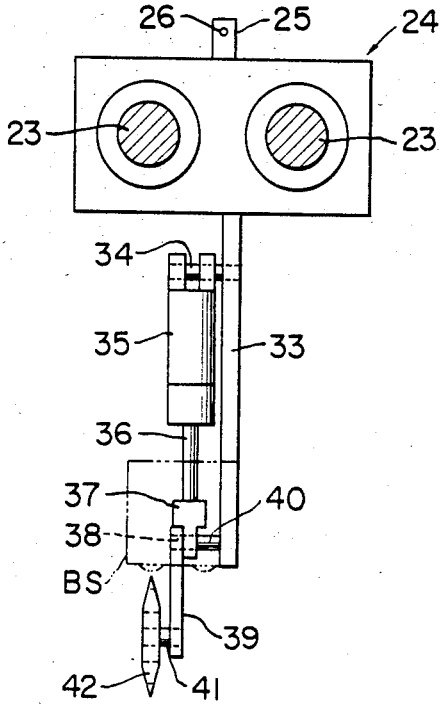
FIG. 6 is an elevation orthogonal to FIG. 5 of the device as viewed from the right in FIG. 5.
Figure 7:
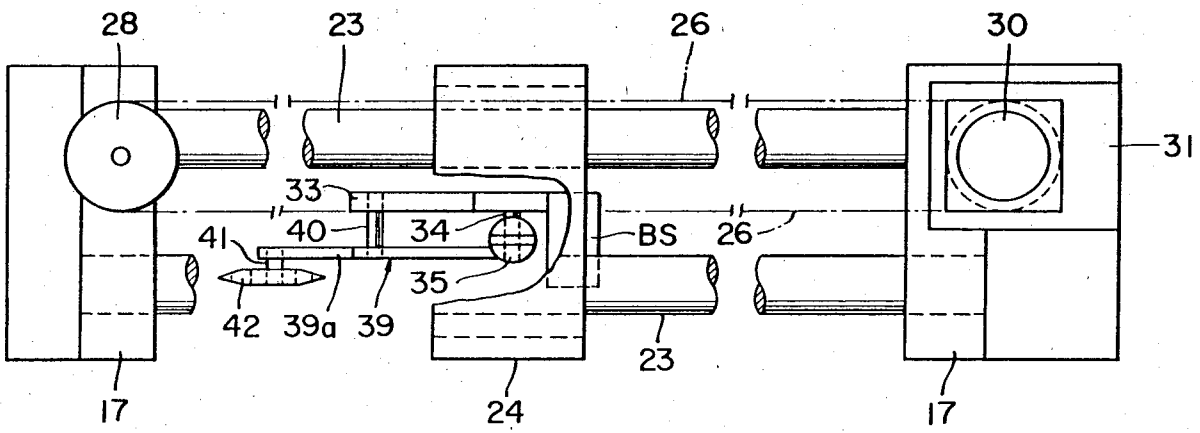
FIG. 7 is a plan view, with parts cut away and parts foreshortened of the same device.

As shown in FIGS. 5, 6, and 7, a rigid support arm 33 of L shape is rigidly fixed to and extends downwards from the bottom of the slide block 24. The upper end of an air cylinder 35 is pivotally supported on this support arm 33 by a pivot pin 34. The air cylinder 35 has at its lower end a downwardly projecting piston rod 36 provided at its lower end with an attachment 37 to which the outer end of one arm of a bent lever 39 is pin connected by a pin 38. The lever 39 at its bent intermediate part is pivotally supported by a pivot pin 40 on the outer extreme end of the support arm 33. A rotary perforating wheel 42 is rotatably supported by a shaft 41 fixed to the outer end of the other arm 39*a* of the lever 39.

A photoelectric tube device BS constituting a device for detecting adhesive tapes is mounted on the support arm 33 at a part near the lower end thereof. Upon detecting an adhesive tape, this photoelectric tube device BS generates a detection signal, which is transmitted to an air cylinder controller 45 (shown in FIG. 5). This controller 45 operates in response to the detection signal with a specific time delay to activate the air cylinder 35 to retract its piston rod 36 upwards. The lever 39 is thereby turned counterclockwise as viewed in FIG. 5, and the perforating wheel 42 is lowered.

The paper feeding apparatus and the tape processing device 50 according to this invention of the above described construction operates in the following manner.

A paper roll R with the wide adhesive tapes Ta stuck along its edge E as shown in FIG. 3 is loaded as a new roll R2 onto the paper feed levers 3 and is moved to the position shown in FIG. 1. By rotating the roll R2 about its axis, its leading edge E is brought directly below the tape processing device 20.

The motor 30 of the tape processing device 20 is then started thereby to cause the slide block 24 to travel from one end of the slide bars 23 towards the other. As the slide block 24 thus travels the tape detection device BS successively detects the adhesive tapes Ta and accordingly transmits detection signals to the air cylinder controller 45, which operates in response to each signal to cause the air cylinder 35 to be activated. The perforating wheel 42 is therefore pressed against each adhesive tape piece Ta thus detected. Since the slide block 24, and therefore the perforating wheel 42, are traveling as described above, the perforating wheel 42 rolls over the tape Ta and cuts therealong a perforation line 15 as shown in FIG. 4.

During this perforating process, the sliding block 24 travels with the tape detecting photoelectric device BS leading the perforating wheel 42, that is, from left to right as viewed in FIGS. 2 and 5. Therefore, after the elapse of a certain time period from the instant the tape detecting device BS detects an adhesive tape Ta, when the perforating wheel 42 reaches the nearest edge of that tape, the air cylinder 35 is operated by a timer of the controller 45 to lower the perforating wheel 42. Then after the further elapse of a certain time period, when the perforating wheel 42 is rolling off the far edge of the tape Ta, the controller 45 operates the air cylinder 35 to return the perforating wheel 42 to its original inoperative position.

The paper roll R2 having adhesive tapes Ta thus processed to have perforated lines 15 then has a web leading edge E which can be easily peeled away from the roll by tearing the tapes along these perforated lines at the time of web splicing.

By the practice of this invention as described above with respect to one embodiment thereof, raveling or separation of the web leading edge part of a paper roll is positively prevented prior to mounting of the roll onto a paper feed apparatus by wide adhesive tape pieces, and, at the time when the web is to be peeled off for web splicing, this can be readily accomplished by utilizing the perforated lines. Furthermore, since the middle portion bearing the perforated line of each adhesive tape is a nontacky zone, the web of the roll can be accurately and positively peeled away at its leading edge E even when the perforated lines have been somewhat inaccurately positioned.

Still another advantage of the tape processing device and method of this invention is that the forming of the perforated lines on the adhesive tapes on a new roll R2 can be carried out automatically.

A further advantage of this invention is that it makes possible removal of packaging paper and defective parts from paper rolls prior to loading the rolls onto the paper feed apparatus, whereby the work load on the operator is reduced. Also by the practice of this invention, full automation of the paper feeding process becomes possible by combining the steps of automatic paper roll loading, adhesive application, and splicing.

What is claimed is:

1. A device for preparing for splicing a new paper roll for a rotary press or the like, the paper roll being rotatably supported and having a web leading edge held against raveling by a plurality of pieces of strong adhesive tape, said device comprising: a traveling structure mounted for traveling parallelly to and in the vicinity of the web leading edge from one end to the other end of the paper roll; a rotary perforating wheel supported by the traveling structure with freedom to be pressed against and be separated from the surface of the paper roll; driving means for thus moving the rotary perforating wheel against and away from the paper roll surface; tape detecting means so supported on the traveling structure as to detect the adhesive tape pieces as the traveling structure thus travels and to output corresponding detection signals; and control means operating in response to the detection signals to activate the driving means to move the rotary perforating wheel against and along only the adhesive tape pieces and thereby to form a tearable perforated line across only the adhesive tape pieces substantially over and along the web leading edge, whereby tearing of the tape pieces and peeling of the web leading edge part immediately prior to web splicing are facilitated.

2. A device according to claim 1 in which the control means has time delay means operating with a specific time delay after receiving each detection signal from the tape detecting means thereby to position the perforated lines accurately on the adhesive tape pieces.

3. A device according to claim 1 in which the driving means comprises an air cylinder mounted on the traveling structure, and a lever pivoted at an intermediate part thereof to the traveling structure and having one end pivotally connected to the piston rod of the air cylinder, said lever carrying the rotary perforating wheel on the other end.

* * * * *